US009925505B2

(12) United States Patent
Tannous

(10) Patent No.: US 9,925,505 B2
(45) Date of Patent: Mar. 27, 2018

(54) MATERIAL HANDLING SYSTEM AND APPARATUS

(71) Applicant: Bishara Tannous, Pompano Beach, FL (US)

(72) Inventor: Bishara Tannous, Pompano Beach, FL (US)

( * ) Notice: Subject to any disclaimer, the term of this patent is extended or adjusted under 35 U.S.C. 154(b) by 0 days.

(21) Appl. No.: 14/932,646

(22) Filed: Nov. 4, 2015

(65) Prior Publication Data

US 2016/0121283 A1 May 5, 2016

Related U.S. Application Data

(60) Provisional application No. 62/074,959, filed on Nov. 4, 2014.

(51) Int. Cl.

| | |
|---|---|
| ***B01F 15/00*** | (2006.01) |
| ***A24F 47/00*** | (2006.01) |
| ***B01F 7/00*** | (2006.01) |
| ***B01F 13/00*** | (2006.01) |
| ***B01F 15/02*** | (2006.01) |

(52) U.S. Cl.

CPC ..... *B01F 15/00506* (2013.01); *A24F 47/00* (2013.01); *B01F 7/001* (2013.01); *B01F 7/00158* (2013.01); *B01F 7/00691* (2013.01); *B01F 13/002* (2013.01); *B01F 15/00538* (2013.01); *B01F 15/027* (2013.01); *B01F 2015/00623* (2013.01)

(58) Field of Classification Search

CPC ..... A24C 5/1826; A24B 7/04; A24B 7/08; A24B 7/10; A24B 7/14; F16H 31/002; A47J 42/14; A47J 42/16; A47J 42/46; A47J 43/08; A47J 43/25; A47J 43/255; B02C 9/04; B02C 23/16; B02C 2023/165; B02C 18/062; B02C 18/083; B02C 18/10; B02C 18/2216; A24F 47/00; B01F 7/001; B01F 7/00158; B01F 7/00691; B01F 13/002; B01F 15/00538; B01F 15/027; B01F 15/00506

USPC ..... 241/69–70, 100, 101.01–101.8; 131/77–83.1, 173, 319; 222/142, 216, 222/218, 220, 226–248, 145.6; 141/18, 141/67, 69

See application file for complete search history.

(56) References Cited

U.S. PATENT DOCUMENTS 1,383,935 A * 7/1921 Guill ..... A24F 23/00 131/329
1,763,546 A * 6/1930 Wysong ..... A24C 1/02 131/108
3,035,740 A * 5/1962 Burch ..... A01C 15/00 222/139

(Continued)

*Primary Examiner* — Nicholas J Weiss
*Assistant Examiner* — Andrew P Bainbridge
(74) *Attorney, Agent, or Firm* — Mayer Brown LLP

(57) ABSTRACT

The invention relates generally to a material handling device to perform the tasks of mixing and dispensing a mixture of materials, either simultaneously or sequentially. The material handling device may comprise an enclosure, a mixing component, a dispensing orifice, a dispensing component, and a material storage region, wherein the mixing component is positioned within the material storage region and configured to mix, stir, agitate, loosen, grind, shred, or otherwise reposition a mixture of materials within the material storage region.

6 Claims, 7 Drawing Sheets

(56) References Cited

U.S. PATENT DOCUMENTS

| | | | | |
|---|---|---|---|---|
| 3,604,489 | A * | 9/1971 | Laszlo | A24B 7/00 131/311 |
| 5,913,484 | A * | 6/1999 | Kurtz | B26D 1/12 241/100 |
| 8,727,251 | B2 * | 5/2014 | Loos | B02C 18/0084 241/100 |
| 9,427,020 | B2 * | 8/2016 | Ruzycky | A24C 5/02 |
| 2008/0017737 | A1 * | 1/2008 | So | A47J 43/255 241/93 |
| 2008/0203201 | A1 * | 8/2008 | Deppermann | B02C 18/12 241/25 |
| 2009/0045274 | A1 * | 2/2009 | So | A47J 43/044 241/169.1 |
| 2012/0168544 | A1 * | 7/2012 | Chaoui | B02C 18/08 241/68 |
| 2015/0330484 | A1 * | 11/2015 | Harris | A47J 43/1031 241/199.12 |
| 2016/0029691 | A1 * | 2/2016 | Ruzycky | A24C 5/02 241/24.1 |
| 2016/0121283 | A1 * | 5/2016 | Tannous | B01F 15/00506 222/226 |

* cited by examiner

MATERIAL HANDLING SYSTEM AND APPARATUS

FIELD OF THE INVENTION

The present invention is directed to a device for material handling. More specifically, an aspect of the present invention is directed to a material mixing and dispensing device that performs the tasks of mixing and dispensing a mixture of materials. One embodiment of the invention is directed to a device for mixing and dispensing tobacco preparations.

BACKGROUND OF THE INVENTION

Certain mixtures of materials contain solid or semi-solid media mixed with or coated in liquids, especially highly viscous liquids such as glycerin, honey, and molasses. One example of such a mixture is a preparation of smoking tobacco. For example, tobacco preparations intended for use in a "hookah" are often sticky, clumpy, and require mixing and loosening to be properly dispensed for smoking or packaging. As a result, such tobacco preparations can be messy to handle and typically settle after being stored over time. In order to achieve increased heat and mass transfer through the tobacco preparation during smoking, a user must agitate the mixture before introducing it into the hookah. Individuals desiring to use such preparations of tobacco must manually manipulate the mixture which results in materials being deposited on the user's hands or another utensil being used. Some users also desire to create a mixture by combining two or more materials, to mix two different mixtures together, or to introduce additional material(s) into a mixture. In these situations, a consistent mixture is the desirable end product, and the user must manually manipulate multiple materials, and it may be difficult or inefficient to achieve a uniform mixture with currently available tools. Other users may desire to dispense materials or mixtures of materials without having to touch the materials with their hands or a foreign object. In this situation, a user is unable to properly manipulate the materials and it may be difficult to achieve accurate or efficient dispensing. Therefore, a need exists for a device that enables a user to execute one or more of these tasks in a clean, efficient, and effective manner. Such a device should enable the controlled dispersal, storage, and/or transportation of a relatively consistent mixture of materials, including, for example, tobacco. Thus, as will be discussed in greater detail below, the present invention is generally directed to a material handling device that performs the tasks of mixing and dispensing a mixture of materials, either simultaneously or sequentially.

BRIEF SUMMARY OF THE INVENTION

According to a first aspect, a device for mixing and dispensing tobacco comprises: an enclosure, the enclosure defining a material storage region, wherein the material storage region is configured to contain a tobacco mixture; a mixing component, wherein said mixing component is positioned within the material storage region; a hand crank external to the enclosure, wherein the hand crank is operatively coupled to the mixing component and configured to rotate the mixing component; a dispensing component, wherein the hand crank is operatively coupled to the mixing component and the dispensing component by way of a plurality of gears; and a dispensing orifice.

According to a second aspect, a device for mixing and dispensing tobacco comprises: an enclosure, the enclosure defining a material storage region, wherein the material storage region is configured to contain a tobacco mixture; a mixing component, wherein said mixing component is positioned within the material storage region; and a dispensing orifice.

According to a third aspect, a device for mixing and dispensing a mixture of materials comprises: an enclosure, said enclosure defining a material storage region; a mixing component, wherein said mixing component is positioned within the material storage region; and a dispensing orifice.

According to a fourth aspect, a device for mixing and dispensing a mixture of materials comprises: an enclosure; a material storage region; a mixing component, wherein the mixing component is positioned within the material storage region; a dispensing orifice; and a dispensing component. The device may further comprise a hand crank, an electric motor, or some other rotational source, operatively coupled to the mixing component, and configured to cause rotation of the mixing component. The mixing component may be configured to mix, stir, agitate, loosen, grind, shred, and/or otherwise reposition a mixture of materials within the material storage region.

In certain aspects, the device may comprise a hand crank external to the enclosure, wherein the hand crank is operatively coupled to the mixing component and configured to rotate the mixing component.

In certain aspects, the device may comprise a dispensing component.

In certain aspects, the hand crank is operatively coupled to the mixing component and the dispensing component by way of a motion mechanism.

In certain aspects, the mixing component is configured to mix, stir, agitate, loosen, grind, shred, or otherwise reposition the tobacco mixture within the material storage region.

In certain aspects, the enclosure comprises a plurality of subassemblies, wherein the plurality of subassemblies allows the user to load or remove the tobacco mixture from the material storage region.

In certain aspects, the mixing component is operatively coupled to the dispensing component and configured to rotate the dispensing component.

In certain aspects, the mixing component is operatively coupled to the dispensing component by way of a motion mechanism.

In certain aspects, the device may comprise a motor operatively coupled to the mixing component, and configured to rotate the mixing component.

In certain aspects, the motor is operatively coupled to the dispensing component by way of a motion mechanism.

In certain aspects, the motion mechanism comprises a plurality of gears.

In certain aspects, the material storage region is a detachable or separate vessel with a means of attaching and detaching to the enclosure and the enclosure includes one or more means of receiving one or more separate material storage regions.

In certain aspects, the material storage region comprises a replaceable, single-use, or disposable vessel.

BRIEF DESCRIPTION OF THE FIGURES

The invention can be better understood with reference to the following drawings and description. The components in the figures may not necessarily be to scale, emphasis, instead, being placed upon illustrating the principles of certain embodiments of the invention. Moreover, in the figures, like-referenced numerals designate corresponding parts throughout the different views.

DETAILED DESCRIPTION OF THE INVENTION

Embodiments of the present invention will be described hereinbelow with reference to the accompanying drawings. Alternate embodiments may be devised without departing from the spirit or the scope of the invention. In the following description, well-known functions or constructions may be not described in detail because they would obscure the invention in unnecessary detail. For this application, the following terms and definitions may apply:

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention," "embodiments" or "invention" do not require that all embodiments of the invention include the discussed feature, advantage or mode of operation.

As discussed above, some mixtures of materials, including hookah tobacco preparations, contain viscous liquids such as glycerin, honey, and molasses, which can be messy to handle and may settle after being stored over time. The present invention, however, provides a material handling device that performs the tasks of mixing and dispensing a mixture of materials. A combination mixing and dispensing device can be practical in, inter alia, two applications: first, in the application of dispersing the mixture of materials directly into a vessel for use, and second, in the application of packaging the mixture of materials for resale or other disposition. Such a material handling device allows a user to perform a few motions to execute these tasks in a clean, efficient, and effective manner. Operation of such a device would result in the dispersal of a relatively consistent mixture of materials.

Figure 1:
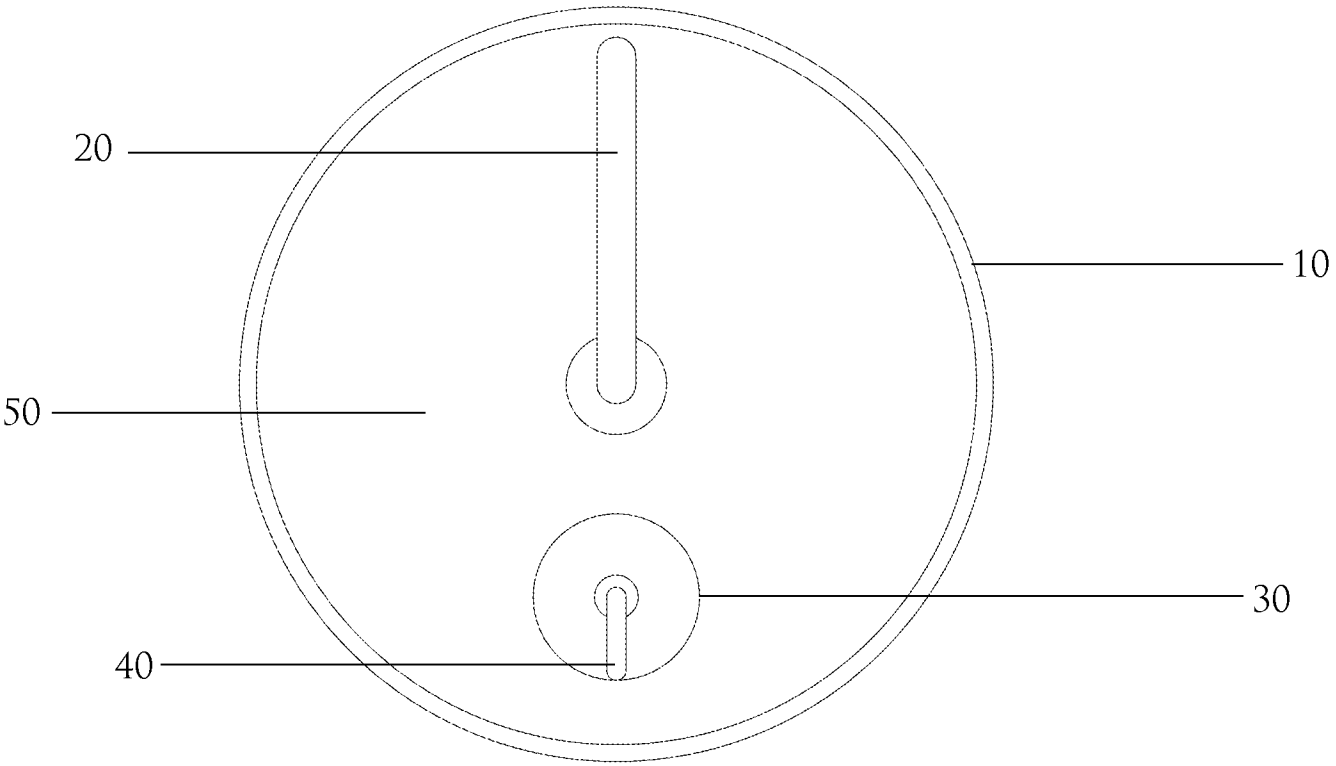
FIG. 1 is a diagram depicting a schematic view of a material handling device.
Figure 2B:
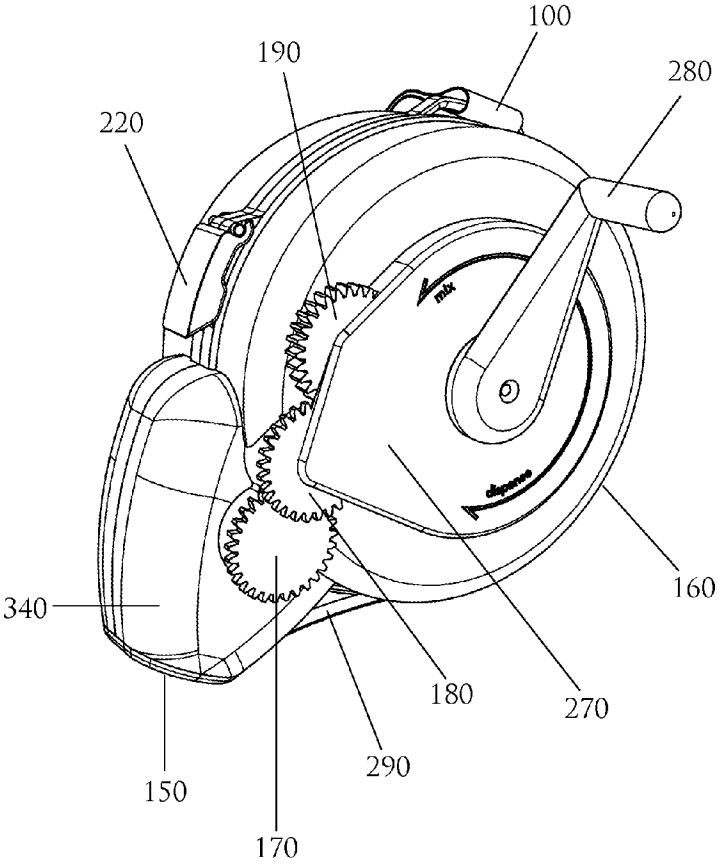
FIG. 2B is a diagram depicting a right frontal perspective view of a material handling device.
Figure 2A:
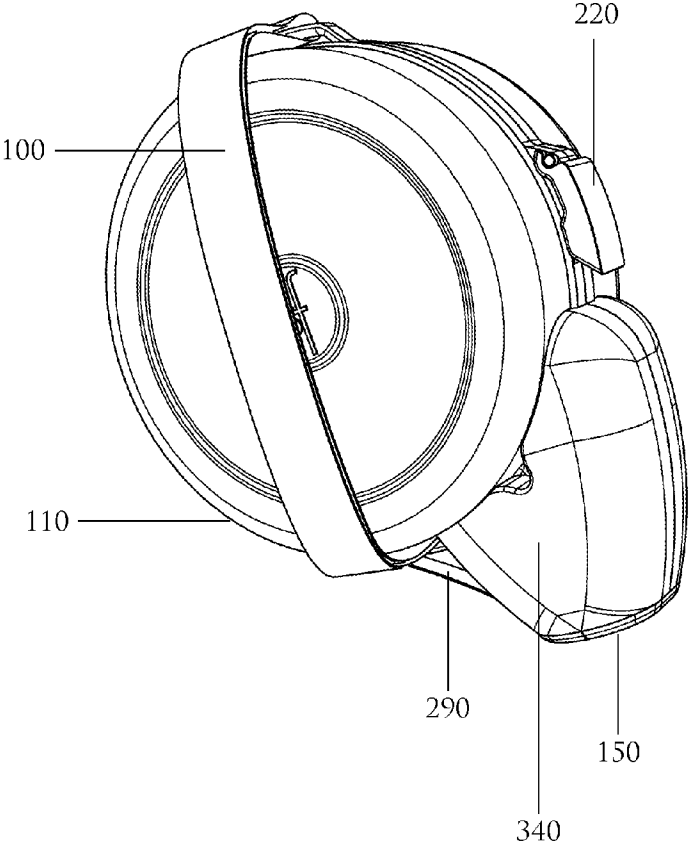
FIG. 2A is a diagram depicting a left frontal perspective view of a material handling device.
Figures 3A, 3B, 3C:
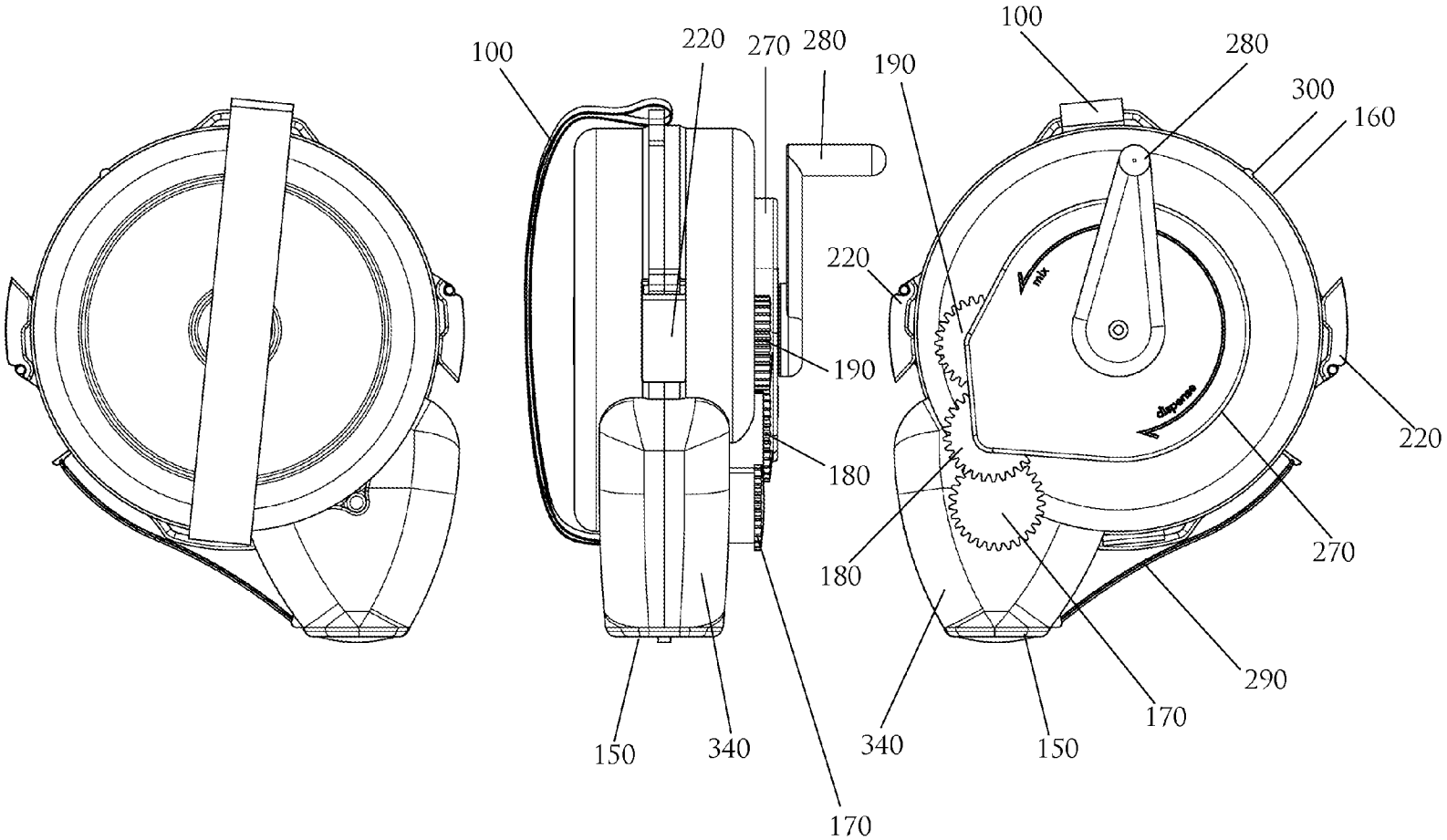
FIG. 3A is a diagram depicting a left side view of a material handling device.
FIG. 3B is a diagram depicting a front view of a material handling device.
FIG. 3C is a diagram depicting a right side view of a material handling device.
Figure 4:
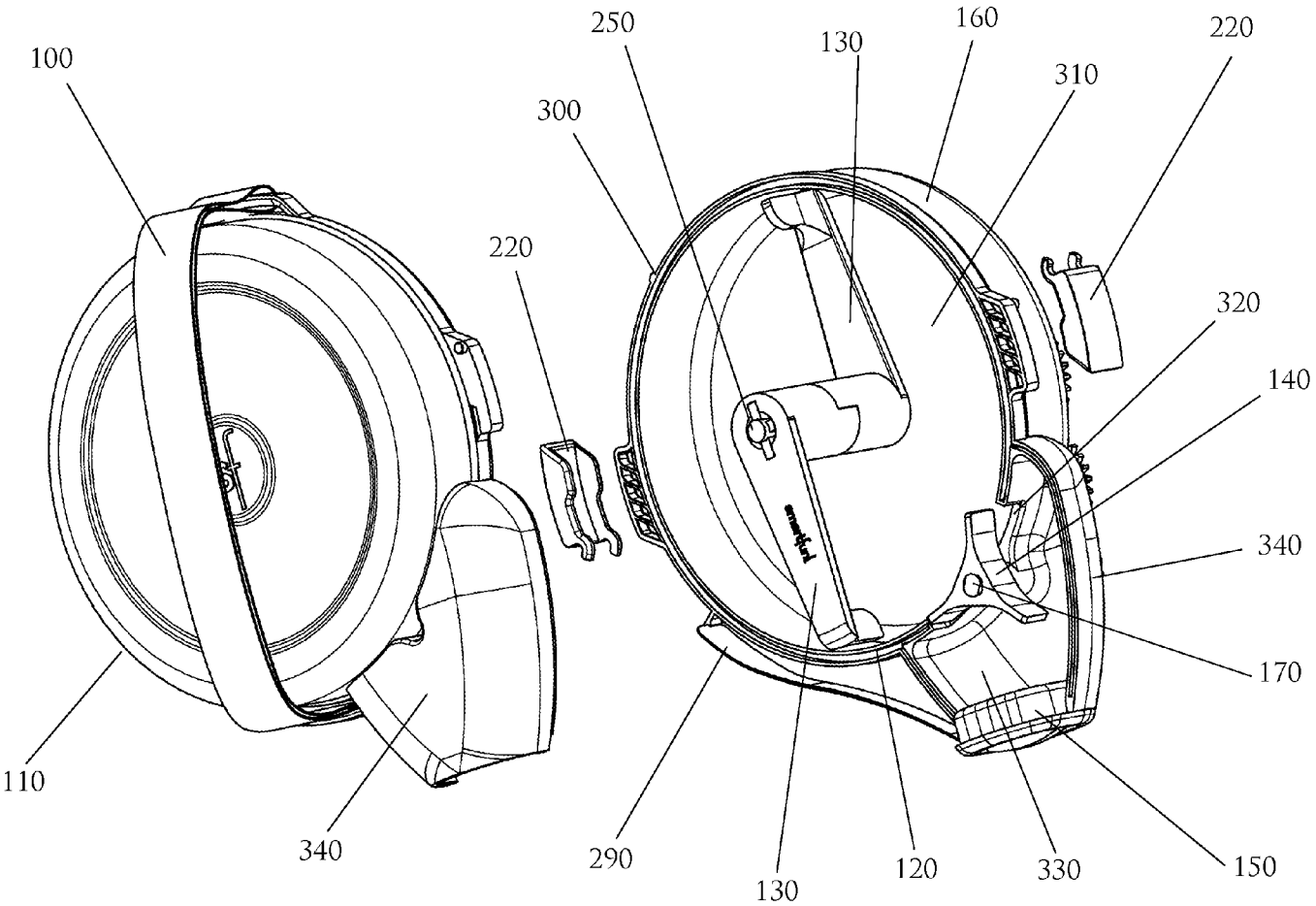
FIG. 4 is a diagram depicting an opened view of a material handling device.
Figure 5A:
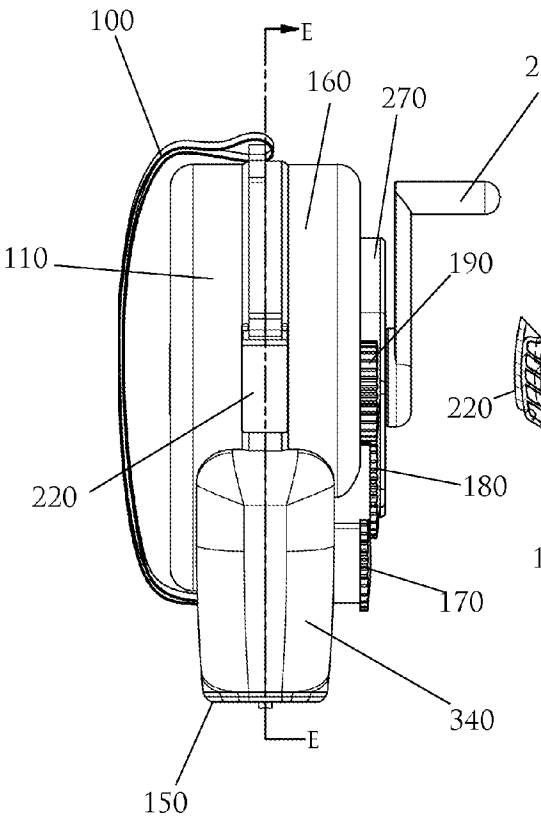
FIG. 5A is a diagram depicting a front view of a material handling device.
Figure 5B:
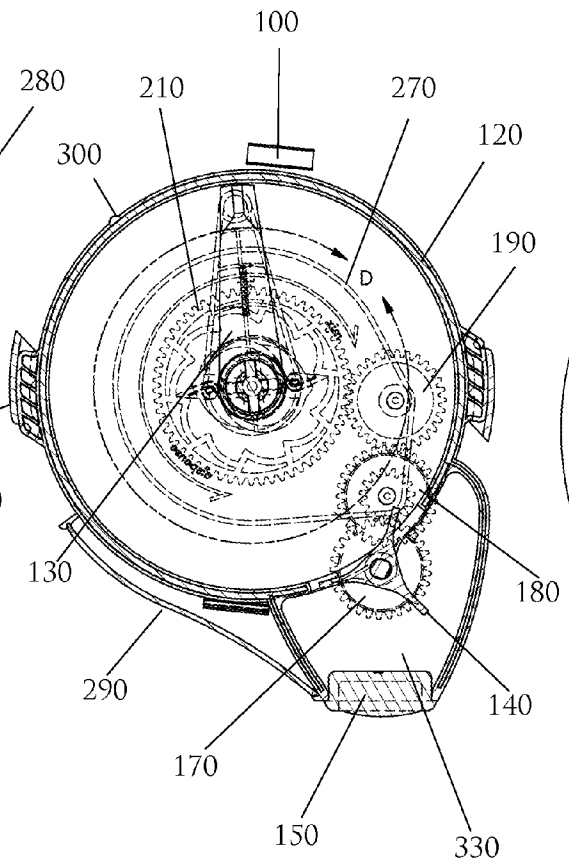
FIG. 5B is a diagram depicting a section view of the material handling device in FIG. 5A along lines E-E.
Figure 5C:
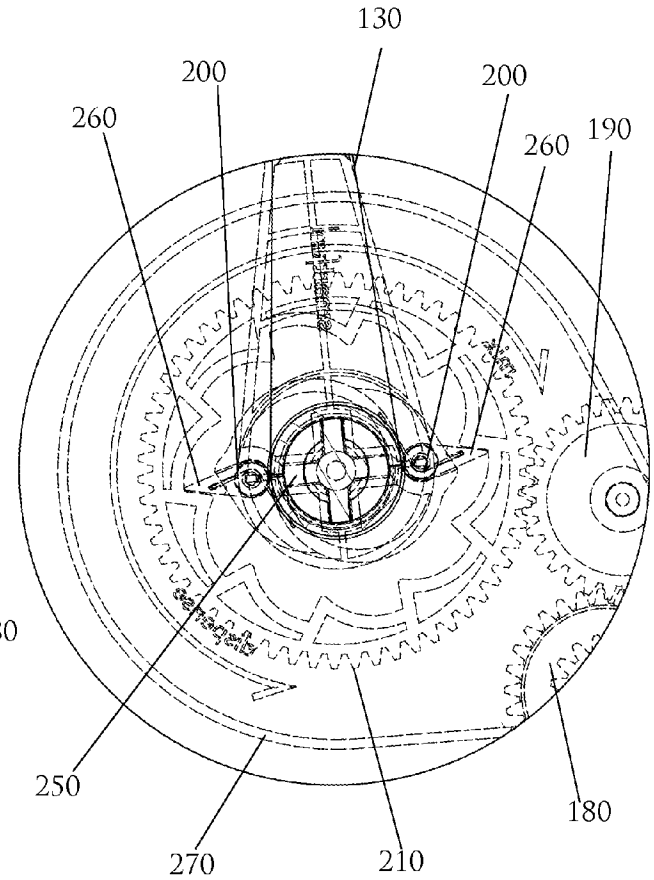
FIG. 5C is a diagram depicting a detail view of the material handling device in FIG. 5B around line D.
Figure 6A:
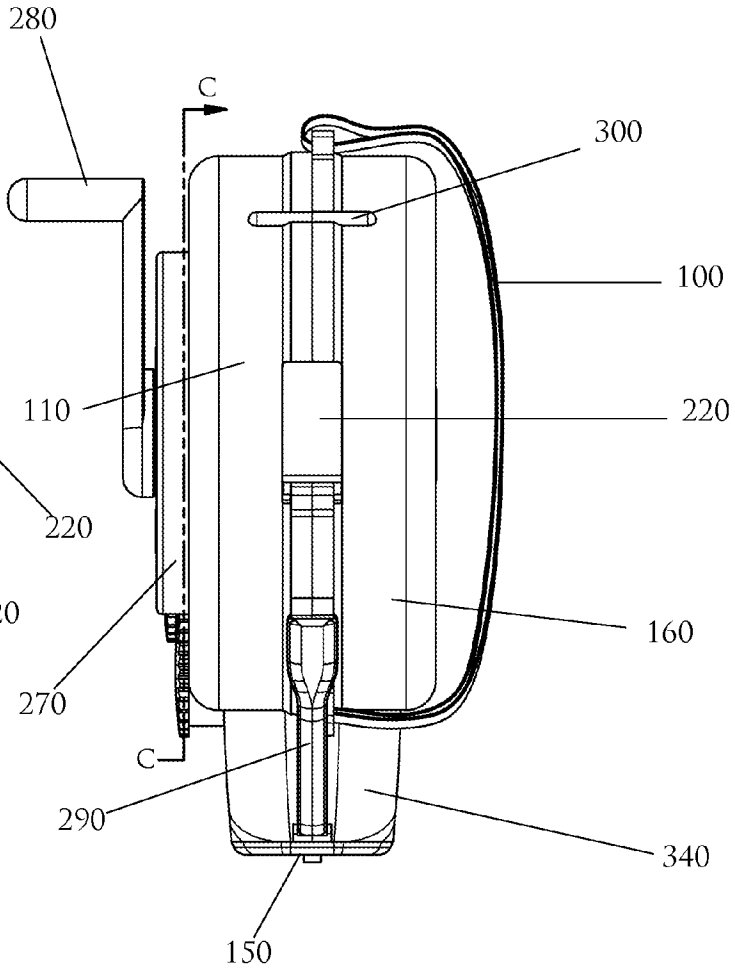
FIG. 6A is a diagram depicting a back view of a material handling device.
Figure 6B:
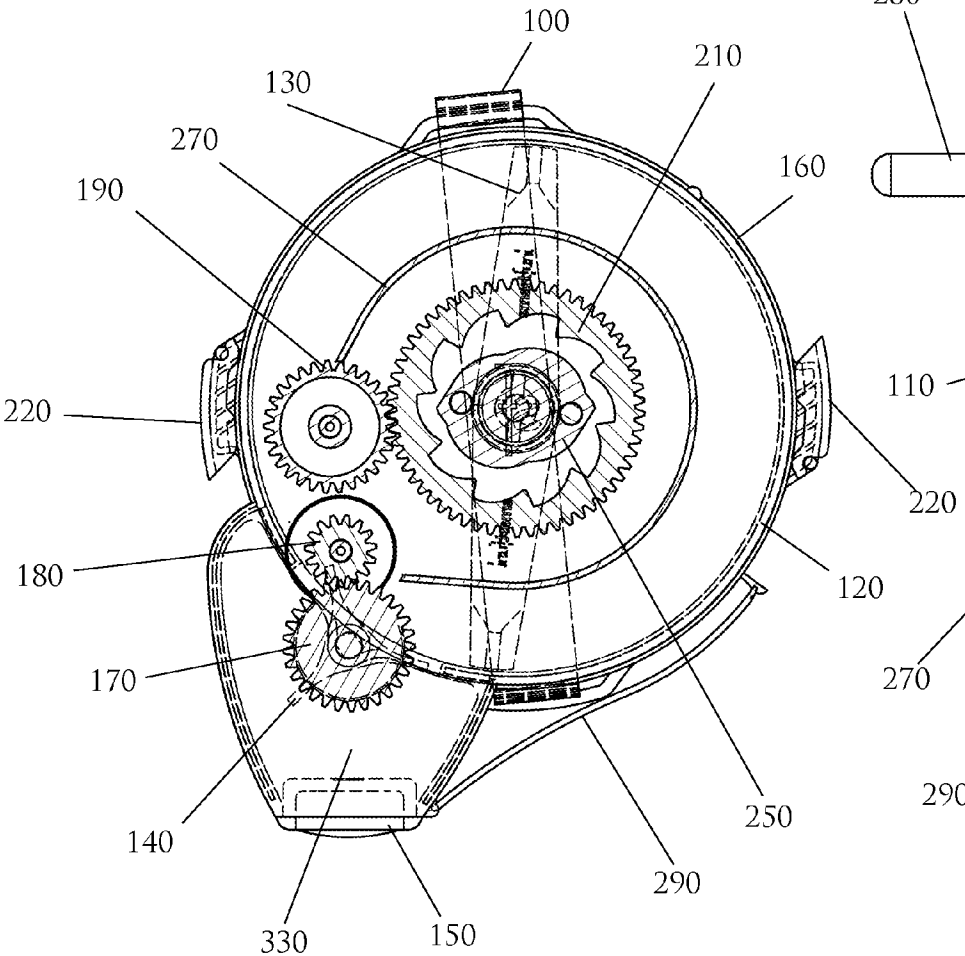
FIG. 6B is a diagram depicting a section view of the material handling device in FIG. 6A along lines C-C.
Figure 7:
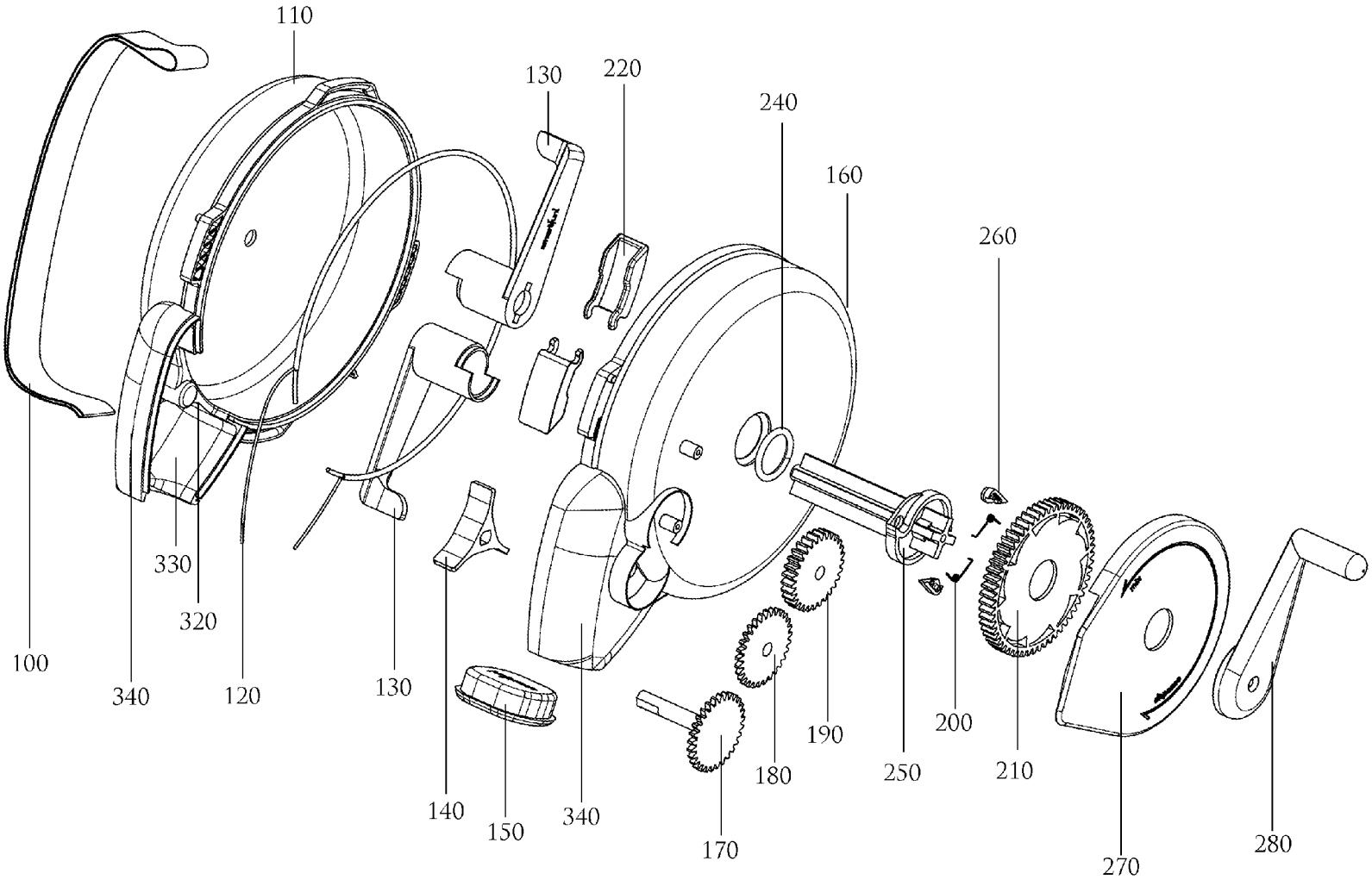
FIG. 7 is a diagram depicting an exploded view of the components of a material handling device.

Referring to FIG. 1, a material handling device may include an enclosure 10, mixing component 20, dispensing orifice 30, dispensing component 40, and material storage region 50. In the configuration illustrated by FIG. 1, the mixing component and the dispensing component are mechanically coupled to transfer power between the mixing component and the dispensing component in such a way that controlling one will also control the other; however, the mixing and dispensing components are not required to be mechanically connected in other configurations. In certain aspects, as illustrated in FIG. 4, the distal end of the mixing component and/or the dispensing component may be shaped for increased material handling. For example, the ends may be flattened, scalloped, or otherwise shaped to increase surface area contact with the material, thereby moving an increased amount of material.

Referring to FIGS. 2A-7, for example, a material handling device may include one or more mixing components 130, dispensing orifices 320 and 330, dispensing component 140, material storage region 310 defined by enclosures 110 and 160. The enclosures 110 and 160 may be sealed using gaskets 120 and 240, as well as plug 150. In certain aspects, enclosures 110 and 160 may be fastened together by latch clips 220. The configuration illustrated in FIGS. 2A-7 includes a primary mechanism that powers the function of the device using human power by hand crank 280 that may be turned to rotate mixing components 130, which are both fixed to spindle 250. When the hand crank 280 is turned either clockwise or counterclockwise, spindle 250 and mixing components 130 will also turn with the purpose to mix and loosen the mixture of materials, yet when the hand crank is turned in the clockwise direction, in addition to rotating the mixing components, a gear train comprising of gears 210, 170, 180, and 190 is also engaged to rotate the dispensing component 140 in order to dispense the mixture through dispensing orifices 320 and 330. The spindle 250, pawl 260, torsion spring 200, gear 210, and retaining plate 270 are configured to establish a ratcheting mechanism that allows the gear train and dispensing component to be disengaged when the hand crank 280 is turned in the counterclockwise direction, and engaged when the hand crank 280 is turned in the clockwise direction. The device in FIGS. 2A-7 includes a guard 340 affixed to enclosures 110 and 160 with the purpose to precisely direct the flow of the mixture of materials as it is dispersed from the device. Guard 340 can have multiple shapes.

The device can be stationary for table use, or handheld as shown in FIGS. 2A-7. The device can be powered by human, or it may use a motor which can be powered by AC or DC electricity. In such an example, the AC or DC electricity may be provided by a battery (e.g., lithium ion, nickel cadmium, etc.), or through the use of an AC to DC wall adapter.

The configuration shown in FIGS. 2A-7 is a handheld version of the device that includes holding strap 100 for steady handheld operation, stands 300 for the device to be able to sit upright on a surface to avoid potential leaks through the dispensing orifices 320 and 330, and utensil 290 for material preparation, which snaps onto enclosures 110 and 160.

In the configuration shown in FIGS. 2A-7, FIG. 4 diagrams how the device opens into subassemblies in order to load the device with material. After loading the device with material, the device can be closed using a variety of methods, including detachable latch clips 220. Other methods of closure can include, for example, screws, knobs, hinges, snap-fit, clicking mechanisms, slides, buttons, magnetic closures, or any combination thereof. Different methods of closure are suitable for different material mixtures, depending on the grit size of any solid media, the viscosity of any liquid media, and the required level and duration of preservation or protection, depending on the application. In other configurations, materials may be loaded into the device through an opening (e.g., door-like or hinged) in the material storage region and/or enclosure. In further configurations, the material storage region may be a separate vessel, with a means of attaching to or insertion into the enclosure. The material storage region may be a sealable, portable, vessel, and may be made of many different materials, including but not limited to, plastics, metals (e.g., aluminum, or ferrous materials, such as steel), metal alloys, glass, or paper.

The configuration of FIGS. 2A-7 shows a version of the device where the dispensing component 140 and mixing components 130 are in mechanical communication with one another, yet, in other versions, the dispensing and mixing components can be controlled separately, either mechanically or electronically. Furthermore, in configurations where the mixing components and dispensing components are in mechanical communication, the dispensing component(s) can be engaged in a variety of ways during mixing of the mixture of materials, not necessarily limited to a rotational reversal as diagrammed in FIGS. 2A-7. For example, if the user has commenced the rotation of the mixing components, either mechanically or electronically, the dispensing component(s) can then be engaged by several other ways, including, but not limited to, a mechanical button, an electronic activation, a lever, a sliding latch, a knob, a switch, a hook, a bending or pulling motion, or combination thereof.

In configurations where the dispensing component 140 and the mixing components 130 are in mechanical communication with one another, such as the configuration shown in FIGS. 2A-7, power transmission between the components can take place utilizing motion mechanisms, including, but not limited to gears, sheaves, rotors, pulleys, chain and sprocket mechanisms, or any combinations thereof. It can be especially advantageous to have a low ratio (e.g., less than 1) from mixing component to dispensing component, whereby a single rotation of the mixing component results in multiple rotations of the dispensing component. The power transmission may include gears designed for the dual purposes of changing gear ratios and increasing or decreasing torque. In the device depicted in FIGS. 2A-7, for example, gears 210 and 190 have a 2:1 ratio, gears 190 and 180 have a 1:1 ratio, while gears 180 to 170 have a 1:2 ratio. In certain embodiments, the gearing (i.e., motion mechanism(s)) may be adjustable between ratios. For example, certain materials may warrant a faster, or slower, rotational speed. However, one of ordinary skill in the art would appreciate that, in view of the present teachings, the gear ratios may be chosen or adjusted to achieve a desired speed and/or toque for a particular application or material.

As illustrated, the power transmission may be external to the material storage region, thereby mitigating risk of malfunction resulting from material interference with the gears. However, the power transmission may be configured inside the material storage region, provided the power transmission is protected from the material (e.g., using a barrier or power transmission subassembly). Also, while the power transmission's motion mechanism (e.g., gears 170, 180, 190) is illustrated as external to the material storage region and open to the elements, the power transmission's motion mechanism may be covered using, for example, a panel to mitigate risk of obstruction and/or pinching the user.

The material storage region can take form in a variety of shapes, including, but not limited to, a cylinder or a sphere, and can be configured for watertight or airtight storage to preserve and/or protect the materials. The enclosure of the entire device can form the material storage region, or can contain a separate material storage region. If the material storage region is within a larger enclosure, said enclosure can contain a single or multiple material storage region(s). A variety of materials can be used to manufacture the enclosure, or other components of the material handling device, including, but not limited to, plastics (e.g., polyethylene, polypropylene, high-density polyethylene, polyvinyl chloride (PVC), acrylonitrile butadiene styrene (ABS), etc.), metals (e.g., stainless steel, aluminum, tin, metal alloys, etc.), glass, ceramics, or combinations thereof.

Within the material storage region, one or more mixing components can be attached through any of the walls of the material storage region or enclosures of the device. For example, as illustrated, the mixing components may be operatively coupled to the motion mechanism through the substantially flat wall(s) of the cylinder. Mixing components turn on an axis and are used to mix, stir, agitate, loosen grind, shred, and/or otherwise reposition the mixture of materials within the material storage region for the purposes of changing the consistency of the mixture or ensuring the mixture has certain properties, ranging from the initial condition of the mixture at the time of insertion into the material storage region, to a mixture of uniform consistency or other desirable properties, as well as positioning the mixture to be adequately and thoroughly dispensed from the material storage region. Mixing components can have any physical shape, but will typically be shaped to ensure that the material storage region can be substantially emptied of materials by operation of the dispensing component(s). Any version of the device can include one or more mixing component(s) or material storage region(s). In addition, any version of the device can include one or more dispensing component(s), dispensing orifice(s), or guard(s). In certain configurations of the device, the mixing and dispensing component(s) can be integrated into a single part.

Those skilled in the art will readily appreciate that the invention described herein may include other features, materials, or components such as those described herein or otherwise. While exemplary systems, devices, methods, and applications of the invention have been described herein, it should also be understood that the foregoing is illustrative of only a few particular embodiments with exemplary and/or preferred features, as well as principles of the invention, and that various modifications can be made by those skilled in the art without departing from the scope and spirit of the invention. Therefore, the described embodiments should not be considered as limiting of the invention in any way. Accordingly, the invention embraces alternatives, modifications, and variations which fall within the spirit and scope of the invention as set forth in the embodiments herein and accompanying documents, including equivalents thereto.

All documents cited herein, including journal articles or abstracts, published or corresponding U.S. or foreign patent applications, issued or foreign patents, or any other documents, are each entirely incorporated by reference herein, including all data, tables, figures, and text presented in the cited documents.

What is claimed is:

1. A portable device for mixing and dispensing tobacco, the device comprising:

an enclosure, the enclosure defining a material storage region, wherein the material storage region is configured to contain a tobacco mixture;

a mixing component, wherein said mixing component is positioned within the material storage region;

a hand crank external to the enclosure capable of being turned in two directions, wherein the hand crank is operatively coupled to the mixing component and configured to rotate the mixing component when turned in a first direction;

a dispensing component, wherein the hand crank is operatively coupled to the mixing component and the dispensing component by way of a plurality of gears; and a dispensing orifice, wherein the tobacco mixture is dispensed upon turning the hand crank in a second direction.

2. The device of claim 1, wherein the mixing component is configured to mix, stir, agitate, loosen, grind, shred, or otherwise reposition the tobacco mixture within the material storage region.

3. The device of claim 1, wherein the enclosure comprises a plurality of subassemblies, wherein the plurality of subassemblies allows the user to load or remove the tobacco mixture from the material storage region.

4. The device of claim 1, wherein the material storage region is a detachable or separate vessel with a means of attaching and detaching to the enclosure and the enclosure includes one or more means of receiving one or more separate material storage regions.

5. The device of claim 1, wherein the material storage region comprises a replaceable, single-use, or disposable vessel.

6. The device of claim 1, further comprising a strap to facilitate handheld operation.

* * * * *